US010457369B1

(12) United States Patent
McLaughlin

(10) Patent No.: US 10,457,369 B1
(45) Date of Patent: Oct. 29, 2019

(54) FOOT PEDAL-POWERED IMPELLER SYSTEM

(71) Applicant: Shane McLaughlin, Leeds, AL (US)

(72) Inventor: Shane McLaughlin, Leeds, AL (US)

( * ) Notice: Subject to any disclaimer, the term of this patent is extended or adjusted under 35 U.S.C. 154(b) by 0 days.

(21) Appl. No.: 16/037,092

(22) Filed: Jul. 17, 2018

(51) Int. Cl.

| | |
|---|---|
| ***B63H 16/20*** | (2006.01) |
| ***B63H 16/08*** | (2006.01) |
| *B63H 5/15* | (2006.01) |
| *B63B 35/73* | (2006.01) |

(52) U.S. Cl.
CPC ..... *B63H 16/14* (2013.01); *B63H 16/20* (2013.01); *B63B 35/73* (2013.01); *B63H 5/15* (2013.01); *B63H 2016/202* (2013.01)

(58) Field of Classification Search
CPC ..... B63H 16/08; B63H 16/12; B63H 16/14; B63H 16/18; B63H 16/20; B63H 2016/08; B63H 2016/085; B63H 2016/18; B63H 2016/20; B63H 2016/202; B63H 5/15; B63B 35/73
USPC ..... 440/21, 25, 26, 27, 31, 32, 38
See application file for complete search history.

(56) References Cited

U.S. PATENT DOCUMENTS

| | | | | |
|---|---|---|---|---|
| 2,518,168 A | | 8/1950 | Anthony | |
| 4,285,674 A | * | 8/1981 | Chew | B63H 1/04 440/12 |
| 4,349,340 A | | 9/1982 | Hoffmann | |
| 4,795,381 A | | 1/1989 | Willerns | |
| 5,509,831 A | * | 4/1996 | Gelbart | B63H 16/12 440/27 |
| 5,643,020 A | * | 7/1997 | Harris | B63H 16/14 440/31 |
| 5,989,081 A | * | 11/1999 | Lekhtman | B63H 1/08 440/27 |
| 6,241,565 B1 | | 6/2001 | Doroftel | |
| D584,676 S | | 1/2009 | Howard | |
| 9,359,056 B2 | | 6/2016 | Lyons | |
| 2007/0134998 A1 | | 6/2007 | Bucher | |
| 2008/0060569 A1 | | 3/2008 | Howard | |

* cited by examiner

*Primary Examiner* — Daniel V Venne

(74) *Attorney, Agent, or Firm* — Kyle A. Fletcher, Esq.

(57) ABSTRACT

The foot pedal-powered impeller system comprises a foot crank coupled to an impeller drive via a vertical drive shaft. The foot crank, mounted on the top surface of a water craft, may comprise two pedals that couple to a central spindle via crank arms. The spindle may pass through a right angle gear box which translates rotational motion of the spindle into rotational motion of the drive shaft. The drive shaft may turn a shaft gear on the underside of the water craft which engages an impeller tube gear and turns an impeller tube. An impeller mounted within the impeller tube may force water to enter the front of the impeller drive via an intake nozzle, pass through the impeller tube, and exit through a discharge nozzle. The discharge of water may move the water craft.

17 Claims, 6 Drawing Sheets

FOOT PEDAL-POWERED IMPELLER SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of recreational watercraft, more specifically, a foot pedal-powered impeller system.

Summary of Invention

The foot pedal-powered impeller system comprises a foot crank coupled to an impeller drive via a vertical drive shaft. The foot crank, mounted on the top surface of a water craft, may comprise two pedals that couple to a central spindle via crank arms. The spindle may pass through a right angle gear box which translates rotational motion of the spindle into rotational motion of the drive shaft. The drive shaft may turn a shaft gear on the underside of the water craft which engages an impeller tube gear and turns an impeller tube. An impeller mounted within the impeller tube may force water to enter the front of the impeller drive via an intake nozzle, pass through the impeller tube, and exit through a discharge nozzle. The discharge of water may move the water craft.

An object of the invention is to provide a foot powered propulsion system for a water craft.

Another object of the invention is to provide a pair of pedals on the top side of a water craft coupled through a right angle gearbox to vertical drive shaft.

A further object of the invention is to use rotational motion of the drive shaft to turn an impeller on the underside of the water craft.

Yet another object of the invention is to force water through an intake nozzle and out of a discharge nozzle using the impeller.

These together with additional objects, features and advantages of the foot pedal-powered impeller system will be readily apparent to those of ordinary skill in the art upon reading the following detailed description of the presently preferred, but nonetheless illustrative, embodiments when taken in conjunction with the accompanying drawings.

In this respect, before explaining the current embodiments of the foot pedal-powered impeller system in detail, it is to be understood that the foot pedal-powered impeller system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the foot pedal-powered impeller system.

It is therefore important that the claims be regarded as including such equivalent construction insofar as they do not depart from the spirit and scope of the foot pedal-powered impeller system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
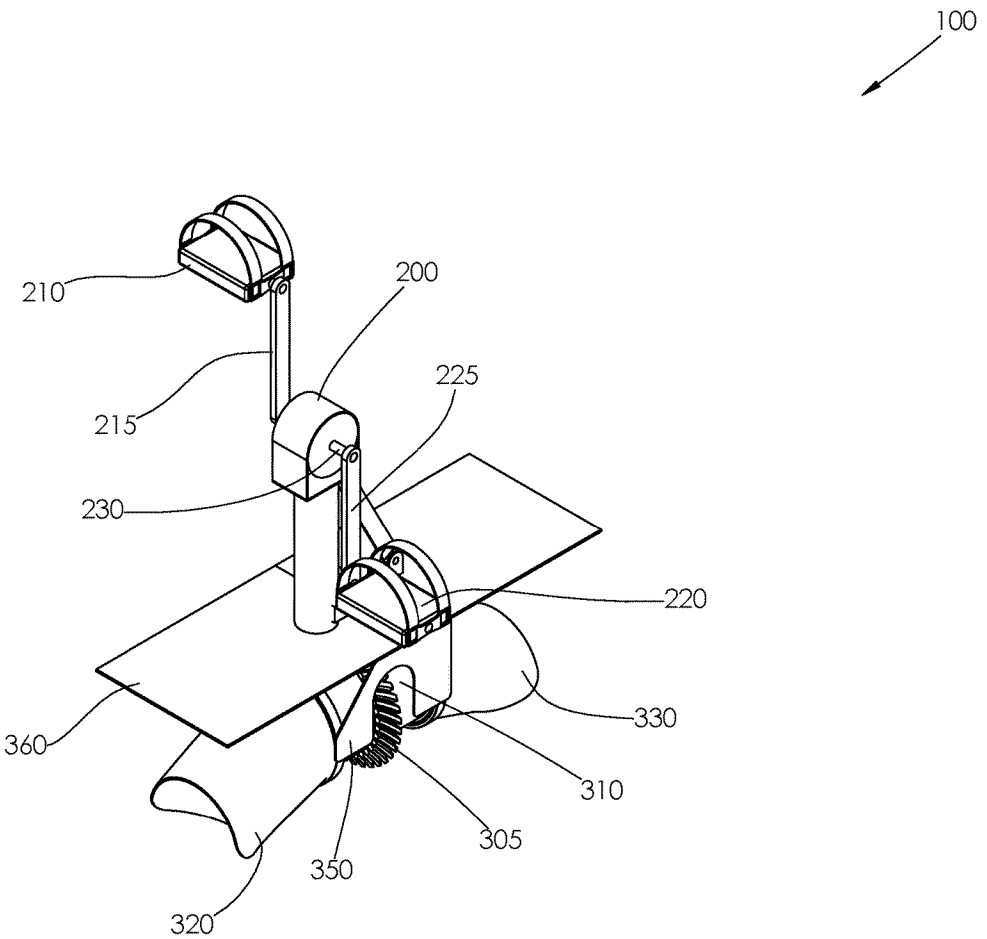
FIG. 1 is a perspective view of an embodiment of the disclosure.
Figure 3:
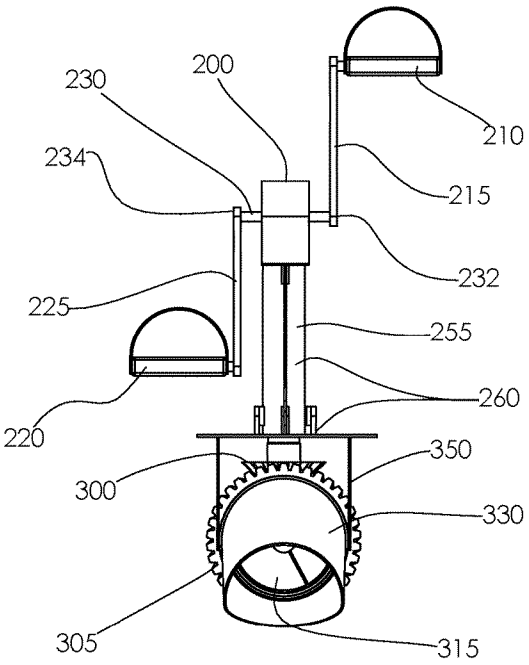
FIG. 3 is a rear view of an embodiment of the disclosure.
Figure 2:
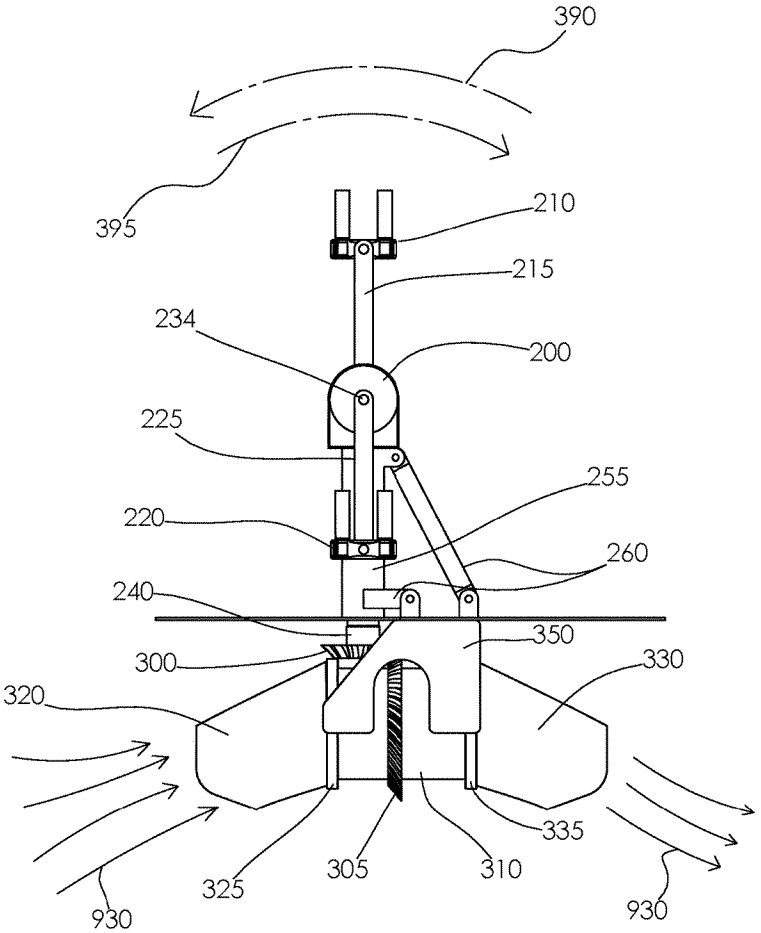
FIG. 2 is a side view of an embodiment of the disclosure.
Figure 4:
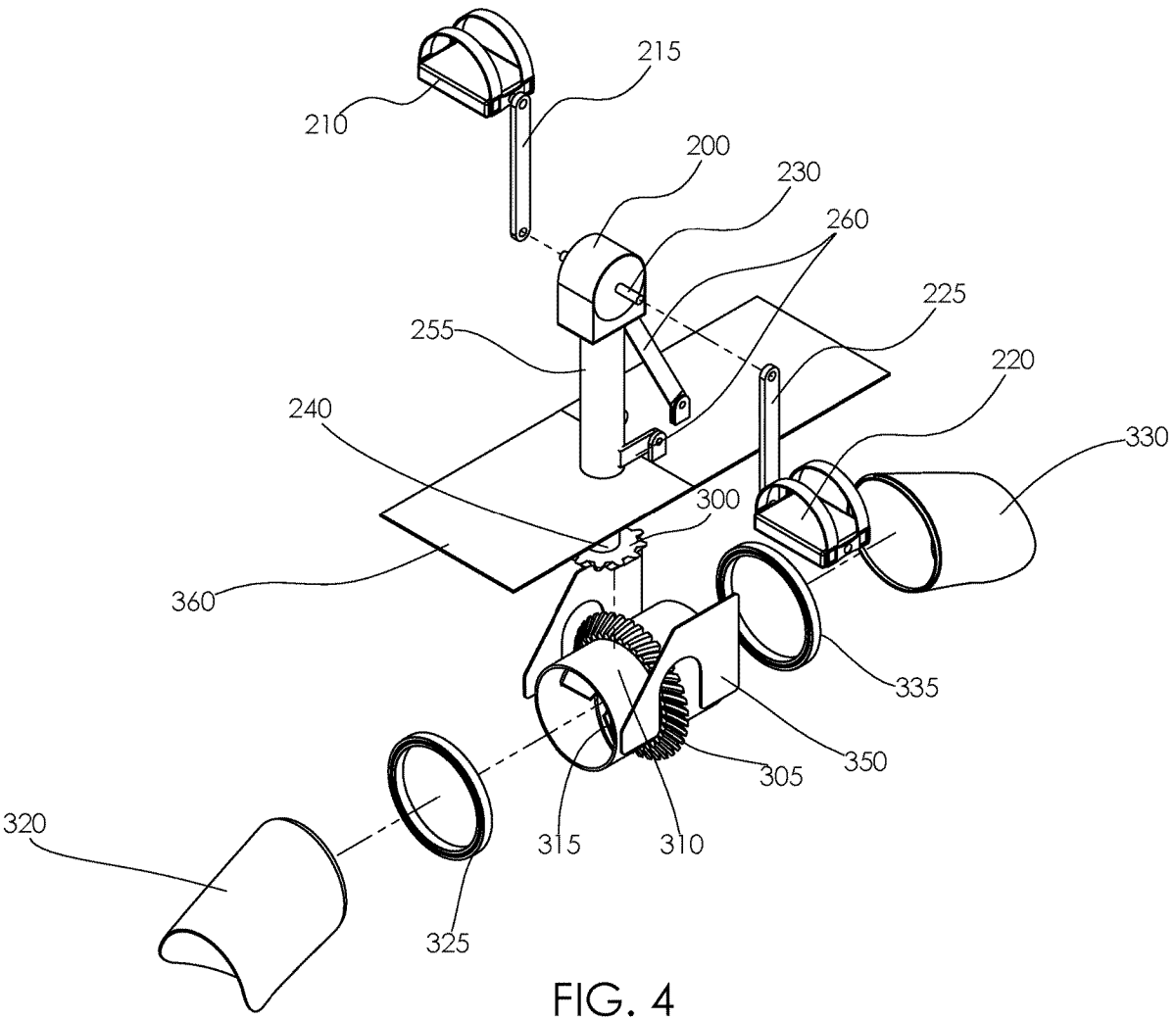
FIG. 4 is an exploded view of an embodiment of the disclosure.
Figure 5:
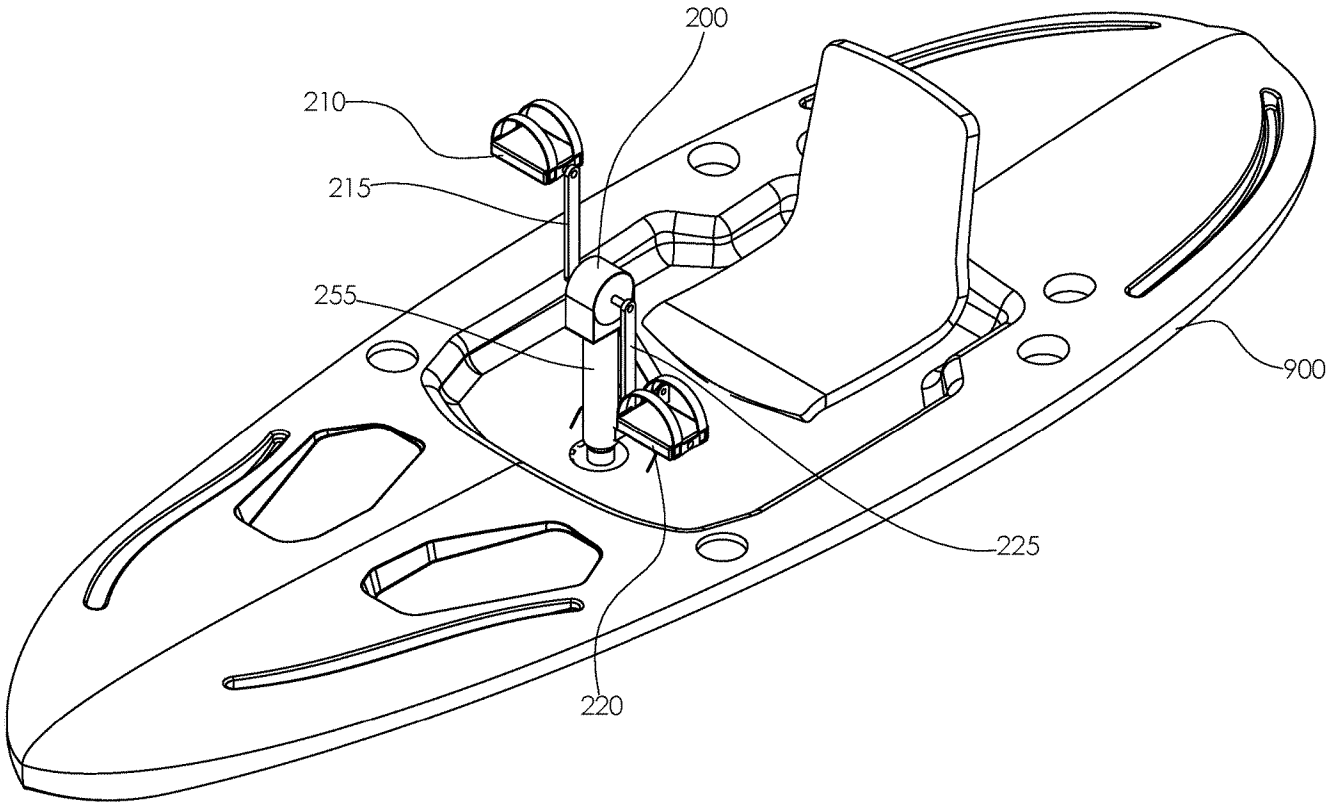
FIG. 5 is a perspective view of an embodiment of the disclosure illustrating the invention installed on a water craft.
Figure 7:
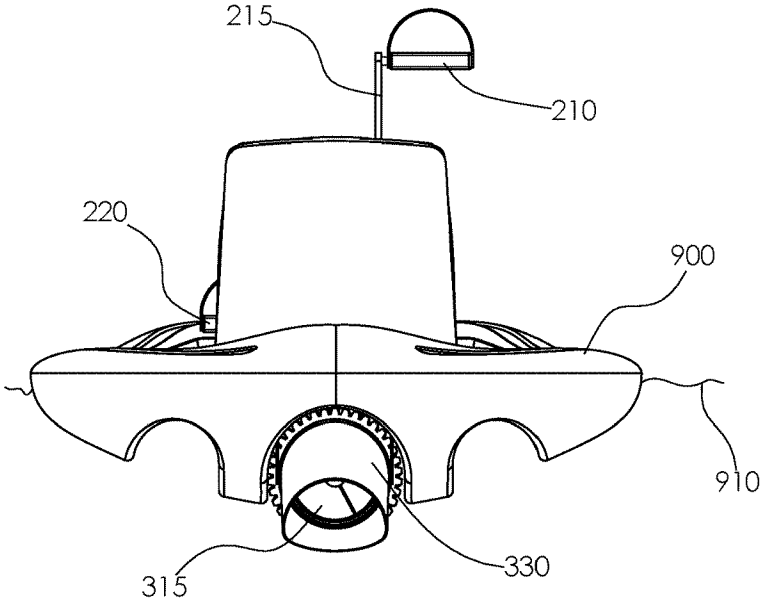
FIG. 7 is a rear view of an embodiment of the disclosure illustrating the invention installed on a water craft.
Figure 6:
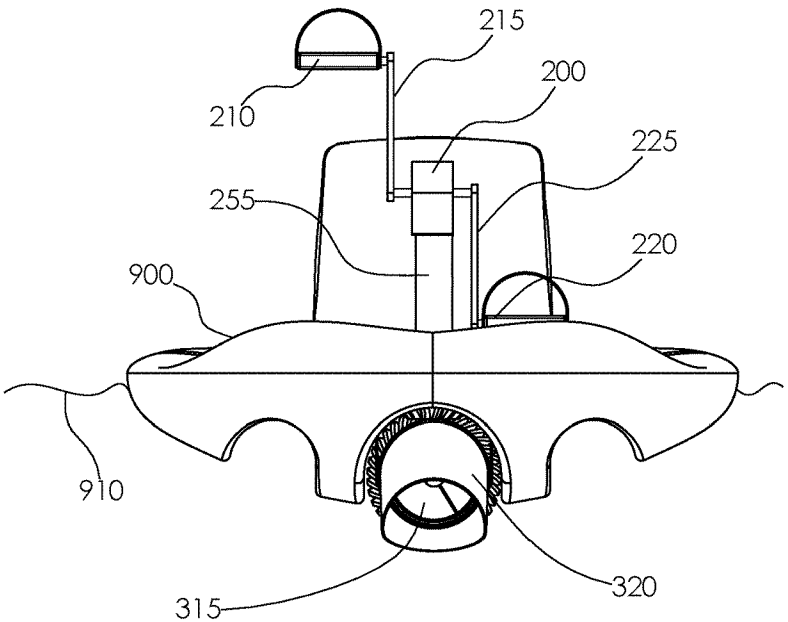
FIG. 6 is a front view of an embodiment of the disclosure illustrating the invention installed on a water craft.
Figure 8:
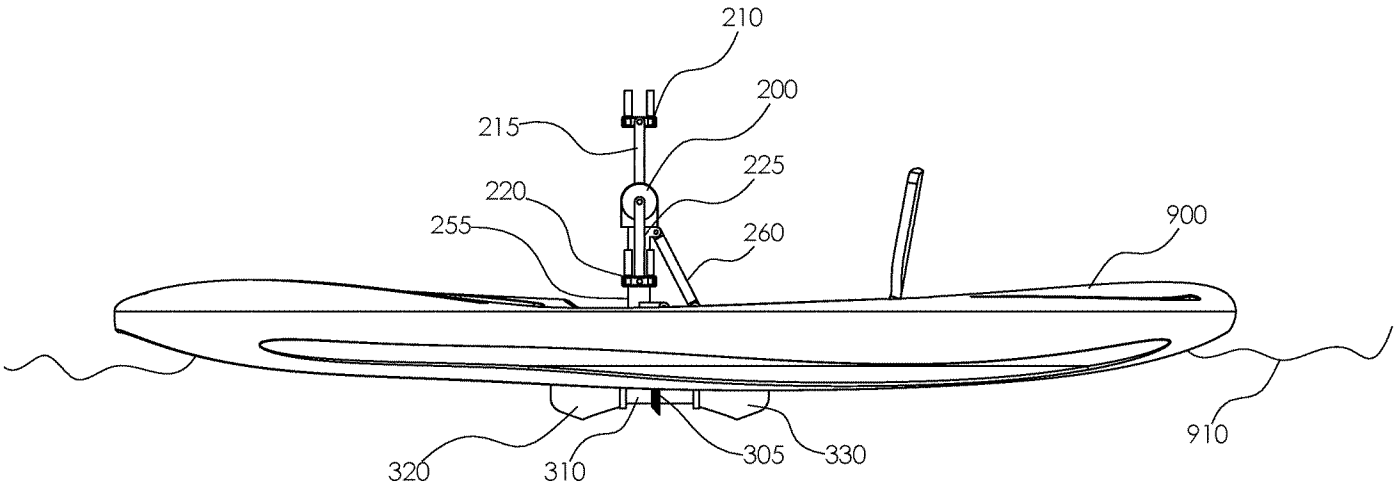
FIG. 8 is a side view of an embodiment of the disclosure illustrating the invention installed on a water craft.
Figure 9:
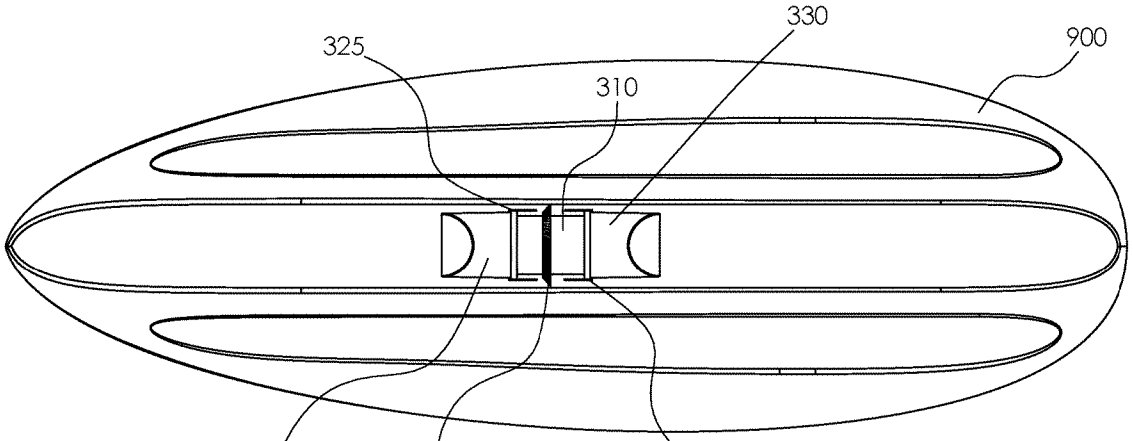
FIG. 9 is a bottom view of an embodiment of the disclosure illustrating the invention installed on a water craft.

Detailed reference will now be made to a first potential embodiment of the disclosure, which is illustrated in FIGS. 1 through 9.

The foot pedal-powered impeller system 100 (hereinafter invention) comprises a foot crank, a drive shaft 240, and an impeller drive. The invention 100 is a boat propulsion system. The invention 100 is adapted to be powered by the feet of a user. The invention 100 may be used in shallower water than conventional propeller-driven propulsion systems.

The foot crank comprises a first pedal 210, a first crank arm 215, a second pedal 220, a second crank arm 225, and a right angle gearbox 200. The foot crank may be adapted to rotate the drive shaft 240 using energy provided by the user.

The first pedal 210 may be a rectangular platform that is used as a foot-operated lever. The first pedal 210 may be rotationally coupled to the first crank arm 215 such that the axis of rotation of the first pedal 210 is oriented horizontally. The first pedal 210 may be coupled to the outside surface of the distal end of the first crank arm 215 such that the first pedal 210 clears the right angle gearbox 200 as it completes each rotation. In some embodiments, one or more foot straps may be provided on the first pedal 210 to hold the user's foot on the first pedal 210. The first crank arm 215 may be an arm that couples the first pedal 210 to a spindle 230 of the right angle gearbox 200. The proximal end of the first crank arm 215 may be coupled to a first end 232 of the spindle 230 at a right angle.

The second pedal 220 may be a rectangular platform that is used as a foot-operated lever. The second pedal 220 may be rotationally coupled to the second crank arm 225 such that the axis of rotation of the second pedal 220 is oriented horizontally. The second pedal 220 may be coupled to the outside surface of the distal end of the second crank arm 225 such that the second pedal 220 clears the right angle gearbox 200 as it completes each rotation. In some embodiments, one or more foot straps may be provided on the second pedal 220 to hold the user's foot on the second pedal 220. The second crank arm 225 may be an arm that couples the second pedal 220 to the spindle 230 of the right angle gearbox 200. The proximal end of the second crank arm 225 may be coupled to a second end 234 of the spindle 230 at a right angle.

The right angle gearbox 200 translates rotational motion of the spindle 230 into rotational motion of the drive shaft 240, which is oriented perpendicularly to the spindle 230. The spindle 230 may pass through the right angle gearbox 200 from side to side. The drive shaft 240 may exit from the right angle gearbox 200 via the bottom of the right angle gearbox 200. The right angle gearbox 200 may enclosed in a housing to prevent injuries and to protect the gears in the right angle gearbox 200.

In some embodiments, the gear ratio within the right angle gearbox 200 may be 1:1 such that each complete rotation of the spindle 230 results in one complete rotation of the drive shaft 240. In some embodiments, the gear ratio within gearbox may be other than 1:1 such that a mechanical advantage is gained. The mechanical advantage may result in a reduction of rotational speed and a simultaneous increase in torque or may result in an increase of rotational speed and a simultaneous reduction in torque.

The drive shaft 240 may be a vertically oriented shaft that is coupled to the right angle gearbox 200 at the top end of the drive shaft 240 and is coupled to a shaft gear 300 at the bottom of the drive shaft 240. The drive shaft 240 may transfer rotational motion from the right angle gearbox 200 to the shaft gear 300. The drive shaft 240 may be supported by a foot crank mount and may be free to rotate within the foot crank mount.

The impeller drive comprises the shaft gear 300, an impeller tube gear 305, an impeller tube 310, an impeller 315, an intake nozzle 320, a discharge nozzle 330, a front bearing 325, and a rear bearing 335. The impeller drive may pull the water 930 in through the intake nozzle 320, pass the water 930 through the impeller tube 310, and may force the water 930 out through the discharge nozzle 330. The impeller tube gear 305 within the impeller tube 310 may cause the water 930 to move through the impeller drive.

The shaft gear 300 may be coupled to the end of the drive shaft 240. The shaft gear 300 may rotate within a horizontal plane as the drive shaft 240 rotates. The shaft gear 300 may engage the impeller tube gear 305 such that rotational motion supplied by the foot crank via the drive shaft 240 causes rotation of the impeller tube gear 305.

The impeller tube 310 may be coupled at one end to the intake nozzle 320 via the front bearing 325. The impeller tube 310 may be coupled at the other end to the discharge nozzle 330 via the rear bearing 335. The impeller tube gear 305 may be coupled to the impeller tube 310 and may surround the impeller tube 310 at a midpoint of the impeller tube 310. The impeller tube 310 may be free to rotate between the intake nozzle 320 and the discharge nozzle 330 when rotation of the shaft gear 300 causes rotation of the impeller tube gear 305. The impeller 315 may be mounted within the impeller tube 310.

The impeller 315 may be one or more blades that move the water 930 when the impeller 315 is rotated. As a non-limiting example, the impeller 315 may be one or more helical blades that rotate around an axis running through the center of the one or more helical blades. The axis of the one or more helical blades may be aligned with the longitudinal axis of the impeller tube 310.

The intake nozzle 320 may be a tube at the front of the impeller drive. The rear end of the intake nozzle 320 may be coupled to the impeller tube 310 via the front bearing 325. The intake nozzle 320 may be supported by an impeller mount 350.

The discharge nozzle 330 may be a tube at the rear of the impeller drive. The front end of the discharge nozzle 330 may be coupled to the impeller tube 310 via the rear bearing 335. The discharge nozzle 330 may be supported by the impeller mount 350.

When the foot crank is operated by pedaling in a first direction 390, the impeller 315 may rotate in a direction that pulls the water 930 in through the intake nozzle 320 and expels the water 930 through the discharge nozzle 330. Pedaling in the first direction 390 may thereby move a water craft 900 forward. When the foot crank is operated by pedaling in a second direction 395, the impeller 315 may rotate in a direction that pulls the water 930 in through the discharge nozzle 330 and expels the water 930 through the intake nozzle 320. Pedaling in the second direction 395 may thereby move the water craft 900 backwards.

In some embodiments, the intake nozzle 320 and/or the discharge nozzle 330 may be oriented at an angle such that the distal end of the intake nozzle 320 and/or the distal end of the discharge nozzle 330 may be lower than their proximal ends.

The front bearing 325 may be a ring that reduces friction between the intake nozzle 320 and the impeller tube 310 as the impeller tube 310 rotates. The rear bearing 335 may be a ring that reduces friction between the impeller tube 310 and the discharge nozzle 330 as the impeller tube 310 rotates. The front bearing 325 and the rear bearing 335 may be parallel to each other. The front bearing 325 and the rear bearing 335 may remain parallel to each other even if the intake nozzle 320 and the discharge nozzle 330 are angled as described above.

The foot crank mount comprises a drive shaft cover 255 and one or more support braces 260. The drive shaft cover 255 may cover the drive shaft 240 and may support the right angle gearbox 200. The one or more support braces 260 may provide support to counter torque resulting from pushing against the right angle gearbox 200 while pedaling. The drive shaft cover 255 and the one or more support braces 260 may be coupled to a mounting plate 360.

The impeller mount 350 may be an arm that supports the intake nozzle 320 and the discharge nozzle 330. The impeller mount 350 holds the intake nozzle 320 and the discharge nozzle 330 in positions such that the impeller tube 310, which is rotationally coupled to both the intake nozzle 320 and the discharge nozzle 330, is free to turn. The impeller mount 350 also aligns the impeller tube gear 305 to mesh with the shaft gear 300. The impeller mount 350 may be coupled to the mounting plate 360.

The mounting plate 360 may be a rectangular plate onto which the drive shaft cover 255, the one or more support braces 260, and the impeller mount 350 are coupled. The drive shaft cover 255 and the one or more support braces 260 may be coupled to the top surface of the mounting plate 360 and the impeller mount 350 may be coupled to the bottom surface of the mounting plate 360. The drive shaft 240 may pass through the mounting plate 360 to reach from the foot crank to the shaft gear 300. The mounting plate 360 may be coupled to the water craft 900.

In use, the invention 100 is mounted on the center of the water craft 900 such that the distal end of the intake nozzle 320 and the distal end of the discharge nozzle 330 are below a waterline 910 with the intake nozzle 320 pointing forward and the discharge nozzle 330 pointing backwards. The invention 100 is also mounted with the foot crank above the top surface of the water craft 900 where it is accessible for pedaling. The user may sit on the water craft 900 behind the foot crank and may pedal the foot crank to move the first pedal 210 and the second pedal 220 in a circular motion, similar to riding a bicycle. The motion of the feet may cause the spindle 230 to rotate, thus driving the right angle gearbox 200 to turn the drive shaft 240. Rotation of the shaft gear 300 at the bottom end of the drive shaft 240 may cause the impeller tube gear 305 to turn and rotate the impeller tube 310. As the impeller tube 310 rotates, the impeller 315 located inside of the impeller tube 310 may force the water 930 to pass through the intake nozzle 320, the impeller tube 310, and the discharge nozzle 330. As the water 930 is forced out of the discharge nozzle 330, it may push the water craft 900 forward. If the direction of pedaling is reversed, the direction of rotation of the impeller 315 is also reversed and the water 930 is forced out of the intake nozzle 320, thus moving the water craft 900 backwards.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, a "bearing" is anything that holds a rotating or sliding shaft or tube. A bearing may guide a moving component, limit the motion of a moving component relative to a fixed component and/or reduce the friction between the moving component and the fixed component.

As used herein, the words "couple", "couples", "coupled" or "coupling", refer to connecting, either directly or indirectly, and does not necessarily imply a mechanical connection.

As used in this disclosure, a "crank" is a handle or an arm that is attached perpendicularly to the axis of rotation of a shaft and that is used for transmitting rotary motion to the shaft.

As used in this disclosure, the terms "distal" and "proximal" may be used to describe relative positions. Distal refers to the object, or the end of an object, that is situated away from the point of origin, point of reference, or point of attachment. Proximal refers to the object, or end of an object, that is situated towards the point of origin, point of reference, or point of attachment. Distal implies 'farther away from' and proximal implies 'closer to'. In some instances, the point of attachment may be the where an operator or user of the object makes contact with the object. In some instances, the point of origin or point of reference may be a center point or a central axis of an object and the direction of comparison may be in a radial or lateral direction.

As used herein, "front" indicates the side of an object that is closest to a forward direction of travel under normal use of the object or the side or part of an object that normally presents itself to view or that is normally used first. "Rear" or "back' refers to the side that is opposite the front.

As used in this disclosure, a "gear" is a toothed wheel, cylinder, or other toothed mechanical element that is used to transmit motion, a change of speed, or a change of direction to second toothed wheel, cylinder, or other toothed mechanical element.

As used in this disclosure, a "helix" is the three dimensional structure that is formed by a wire that is wound uniformly around the surface of a cylinder or a cone. If the wire is wrapped around a cylinder the helix is called a cylindrical helix. If the wire is wrapped around a cone, the helix is called a conical helix. A synonym for conical helix would be a volute. "Helical" is an adjective which indicates that an object is shaped like a helix.

As used in this disclosure, a "housing" is a rigid casing that encloses and protects one or more devices.

As used herein, an "impeller" is a rotating component of a pump that transfers energy delivered to the impeller from a rotating shaft to the fluid being moved through the pump. In some embodiments, the impeller may be a rotor where the fluid is introduced at the center of the rotor and is pushed radially by vanes on the rotor before finally exiting the pump at an outlet located on the circumference of the pump. In some embodiments, impellers may pump the fluid axially using, as a non-limiting example, a spiral shaped impeller.

As used herein, the word "longitudinal" or "longitudinally" refers to a lengthwise or longest direction.

As used here, the word "midpoint" refers to a point near the center of an object. An "exact midpoint" refers to a midpoint that is equidistant from edges of the object in at least one direction. Unless otherwise stated, a midpoint is not required to be at the exact center of the object but instead may be within 50% of the distance from the exact midpoint to the farthest edge.

As used in this disclosure, a "pedal" is a foot operated lever that is used by the foot to power mechanical devices.

As used in this disclosure, a "plate" is a flat, rigid object having at least one dimension that is of uniform thickness and is thinner than the other dimensions of the object. Plates often have a rectangular or disk like appearance. Plates may be made of any material, but are commonly made of metal.

As used in this disclosure, the term "shaft" is used to describe a rigid cylinder that is often used as the handle of a tool or implement. The definition of shaft explicitly includes solid shafts or shafts that comprise a hollow passage through the shaft along the center axis of the shaft cylinder, whether the shaft has one or more sealed ends or not.

With respect to the above description, it is to be realized that the optimum dimensional relationship for the various components of the invention described above and in FIGS. 1 through 9, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A foot pedal-powered impeller system comprising:
- a foot crank, a drive shaft, and an impeller drive;
- wherein the foot pedal-powered impeller system is a boat propulsion system;
- wherein the foot pedal-powered impeller system is adapted to be powered by the feet of a user;
- wherein the foot crank comprises a first pedal, a first crank arm, a second pedal, a second crank arm, and a right angle gearbox;
- wherein the foot crank is adapted to rotate the drive shaft using energy provided by the user;
- wherein the first pedal is a rectangular platform that is used as a foot-operated lever;
- wherein the first pedal is rotationally coupled to the first crank arm such that the axis of rotation of the first pedal is oriented horizontally;
- wherein the first pedal is coupled to the outside surface of the distal end of the first crank arm such that the first pedal clears the right angle gearbox as it completes each rotation;
- wherein the first crank arm is an arm that couples the first pedal to a spindle of the right angle gearbox;
- wherein the proximal end of the first crank arm is coupled to a first end of the spindle at a right angle.

2. The foot pedal-powered impeller system according to claim 1
- wherein the second pedal is a rectangular platform that is used as a foot-operated lever;
- wherein the second pedal is rotationally coupled to the second crank arm such that the axis of rotation of the second pedal is oriented horizontally;
- wherein the second pedal is coupled to the outside surface of the distal end of the second crank arm such that the second pedal clears the right angle gearbox as it completes each rotation;
- wherein the second crank arm couples the second pedal to the spindle of the right angle gearbox;
- wherein the proximal end of the second crank arm is coupled to a second end of the spindle at a right angle.

3. The foot pedal-powered impeller system according to claim 2
- wherein the right angle gearbox translates rotational motion of the spindle into rotational motion of the drive shaft, which is oriented perpendicularly to the spindle;
- wherein the spindle passes through the right angle gearbox from side to side;
- wherein the drive shaft exits from the right angle gearbox via the bottom of the right angle gearbox.

4. The foot pedal-powered impeller system according to claim 3
- wherein the drive shaft is a vertically oriented shaft that is coupled to the right angle gearbox at the top end of the drive shaft and is coupled to a shaft gear at the bottom of the drive shaft;
- wherein the drive shaft transfers rotational motion from the right angle gearbox to the shaft gear;
- wherein the drive shaft is supported by a foot crank mount and is free to rotate within the foot crank mount.

5. The foot pedal-powered impeller system according to claim 4
- wherein the impeller drive comprises the shaft gear, an impeller tube gear, an impeller tube, an impeller, an intake nozzle, a discharge nozzle, a front bearing, and a rear bearing;
- wherein the impeller drive pulls the water in through the intake nozzle, passes the water through the impeller tube, and forces the water out through the discharge nozzle;
- wherein the impeller tube gear within the impeller tube causes the water to move through the impeller drive.

6. The foot pedal-powered impeller system according to claim 5
- wherein the shaft gear is coupled to the end of the drive shaft;
- wherein the shaft gear rotates within a horizontal plane as the drive shaft rotates;
- wherein the shaft gear engages the impeller tube gear such that rotational motion supplied by the foot crank via the drive shaft causes rotation of the impeller tube gear.

7. The foot pedal-powered impeller system according to claim 6
- wherein the impeller tube is coupled at one end to the intake nozzle via the front bearing;
- wherein the impeller tube is coupled at the other end to the discharge nozzle via the rear bearing;
- wherein the impeller tube gear is coupled to the impeller tube and surrounds the impeller tube at a midpoint of the impeller tube;
- wherein the impeller tube is free to rotate between the intake nozzle and the discharge nozzle when rotation of the shaft gear causes rotation of the impeller tube gear;
- wherein the impeller is mounted within the impeller tube.

8. The foot pedal-powered impeller system according to claim 7
- wherein the impeller is one or more blades that move the water when the impeller is rotated.

9. The foot pedal-powered impeller system according to claim 8
- wherein the impeller is one or more helical blades that rotate around an axis running through the center of the one or more helical blades;
- wherein the axis of the one or more helical blades is aligned with the longitudinal axis of the impeller tube.

10. The foot pedal-powered impeller system according to claim 8
- wherein the intake nozzle is a tube at the front of the impeller drive;

wherein the rear end of the intake nozzle is coupled to the impeller tube via the front bearing;

wherein the intake nozzle is supported by an impeller mount.

11. The foot pedal-powered impeller system according to claim 10 wherein the discharge nozzle is a tube at the rear of the impeller drive;

wherein the front end of the discharge nozzle is coupled to the impeller tube via the rear bearing;

wherein the discharge nozzle is supported by the impeller mount.

12. The foot pedal-powered impeller system according to claim 11 wherein when the foot crank is operated by pedaling in a first direction, the impeller rotates in a direction that pulls the water in through the intake nozzle and expels the water through the discharge nozzle;

wherein when the foot crank is operated by pedaling in a second direction, the impeller rotates in a direction that pulls the water in through the discharge nozzle and expels the water through the intake nozzle.

13. The foot pedal-powered impeller system according to claim 12 wherein the intake nozzle and/or the discharge nozzle are oriented at an angle such that the distal end of the intake nozzle and/or the distal end of the discharge nozzle are lower than their proximal ends.

14. The foot pedal-powered impeller system according to claim 12 wherein the front bearing is a ring that reduces friction between the intake nozzle and the impeller tube as the impeller tube rotates;

wherein the rear bearing is a ring that reduces friction between the impeller tube and the discharge nozzle as the impeller tube rotates;

wherein the front bearing and the rear bearing are parallel to each other.

15. The foot pedal-powered impeller system according to claim 14 wherein the foot crank mount comprises a drive shaft cover and one or more support braces;

wherein the drive shaft cover covers the drive shaft and supports the right angle gearbox;

wherein the one or more support braces provide support to counter torque resulting from pushing against the right angle gearbox while pedaling;

wherein the drive shaft cover and the one or more support braces are coupled to a mounting plate.

16. The foot pedal-powered impeller system according to claim 15 wherein the impeller mount supports the intake nozzle and the discharge nozzle;

wherein the impeller mount holds the intake nozzle and the discharge nozzle in positions such that the impeller tube, which is rotationally coupled to both the intake nozzle and the discharge nozzle, is free to turn;

wherein the impeller mount also aligns the impeller tube gear to mesh with the shaft gear;

wherein the impeller mount is coupled to the mounting plate.

17. The foot pedal-powered impeller system according to claim 16 wherein the mounting plate is a rectangular plate onto which the drive shaft cover, the one or more support braces, and the impeller mount are coupled;

wherein the drive shaft cover and the one or more support braces are coupled to the top surface of the mounting plate and the impeller mount is coupled to the bottom surface of the mounting plate;

wherein the drive shaft passes through the mounting plate to reach from the foot crank to the shaft gear;

wherein the mounting plate is coupled to a water craft.

* * * * *